US006332825B1

(12) United States Patent
Henricksen

(10) Patent No.: US 6,332,825 B1
(45) Date of Patent: Dec. 25, 2001

(54) BREAST SUPPORTING GARMENT UTILIZING SLIP RESISTANT MATERIALS TO CONTROL POSITION OF GARMENT

(75) Inventor: Victoria Elizabeth Henricksen, Duluth, MN (US)

(73) Assignee: Victoria E. Henricksen, Duluth, MN (US)

( * ) Notice: Subject to any disclaimer, the term of this patent is extended or adjusted under 35 U.S.C. 154(b) by 0 days.

(21) Appl. No.: 09/649,401

(22) Filed: Aug. 26, 2000

Related U.S. Application Data

(60) Provisional application No. 60/151,304, filed on Aug. 30, 1999.

(51) Int. Cl.[7] ..... A41C 3/00
(52) U.S. Cl. ..... 450/81; 450/1
(58) Field of Search ..... 450/1, 81

(56) References Cited

U.S. PATENT DOCUMENTS 2,079,426 * 5/1937 Schottenfels ..... 2/81
2,289,679 * 7/1942 Porter ..... 2/81
2,524,620 * 10/1950 Cadous ..... 2/81
2,628,356 * 2/1953 Rosenfield et al. ..... 2/81
2,988,087 * 6/1961 Krieger ..... 2/81
3,254,653 * 6/1966 Krieger ..... 2/81
3,276,449 * 10/1966 Morgan ..... 2/81

* cited by examiner

*Primary Examiner*—Gloria M. Hale

(57) ABSTRACT

A torso encircling garment that has a front portion 11 attached to a back portion 12. The front portion has a breast supporting area 16 with non-slip, that is, frictionally adhesive material 15 on the inner surface, or breast supporting area 22 of conventional construction, or supporting area of molded cups that may be padded. The garment may have a front hook and eye closure 24 or back hook and eye closure 33, or be continuous around the torso. The garment may have straps continuous with the front and back 17, conventional straps, or be strapless 30. The areas consisting of a thin layer of non-slip material 15 may be in the straps 10, the cup area 16 or 31, in the front torso area 18, or in the back torso area 12.

1 Claim, 3 Drawing Sheets

BREAST SUPPORTING GARMENT UTILIZING SLIP RESISTANT MATERIALS TO CONTROL POSITION OF GARMENT

CROSS-REFERENCE TO RELATED APPLICATIONS

This application claims benefit of provisional application 60/151,304 Aug. 30, 1999.

BACKGROUND—FIELD OF INVENTION

This invention relates to brassieres and other garments which serve the function of controlling the movement and position of the breasts of the wearer.

BACKGROUND—DESCRIPTION OF THE PRIOR ART

Brassieres and other garments of similar function must stay in their proper position in order to function. In the prior art these garments employ a tight band that encircles the chest or waist, either combined with straps of strapless. These bands may have elastic areas or may be constructed with elastic in the entire band, and this elastic relieves some of the constricting effect of the bands. In a brassiere with straps, the purpose of band is to keep the brassiere from "riding up", and in the strapless brassiere the purpose of the band is to keep the brassiere from sliding down. If the band is not tight enough in a garment with straps, the breasts can slide down and out of their proper place and be below the cup area entirely. The problem of breasts not staying in place was addressed by Larry L. Krieger in U.S. Pat. No. 3,254,653 (1966), in which he patented raised areas in the cup to grip the breasts. In Krieger these raised areas could cause irritation to the delicate skin of the breasts. In U.S. Pat. No. 2,988,087, also Larry L. Krieger, there are "body-gripping knopslike protuberances projecting above the general plane of the fabric" to hold the brassiere in place, that have the same problem, that is, the potential to cause which he patented raised areas in the cup to grip the breasts. Another problem in a irritation to the wearer. C. A. Porter in U.S. Pat. No. 2,289,679, E. Cadous in U.S. Pat. No. 2,524,620, and A. M. Rosenfield et al in U.S. Pat. No. 2,628,356 employ suction either as a plurality of suction cups or "depressions . . . formed as closed suction cups" (Cadous) to prevent slippage. These suction cups can also cause irritation. M. Schottenfels in U.S. Pat. No. 2,079,426 and B. D. Morgan in U.S. Pat. No. 3,276,449 describe brassieres that do not encircle the torso and stay in place on the body through adhesives that stick to the skin. In Schottenfels, the adhesive is "in the character of adhesive material such as surgical or medical tape" which sticks to the skin, and has the disadvantage that it must be replaced with each wearing. The invention of B. D. Morgan employs "pressure sensitive adhesive" and, if the brassiere is to be worn more than once, it must be folded so as to avoid contact between the adhesive layers which is an inconvenience to the owner. Another problem in a brassiere with straps is that the garment can slide up in the back, and down in the front, so that even if the breasts are in the cup area, the breast are lower that the wearer desires, giving the appearance of sagging breasts. In a strapless brassiere, the garment can slide off the breasts and come to rest at the waist.

This tight band causes annoyance or discomfort at best, at worst it can irritate the intercostal muscles and cause pain. The introduction of elastic materials to ease some of the tension around the torso was an improvement, but does not completely solve of problem of discomfort for the wearer.

SUMMARY

In accordance with the invention presented here, my garment comprises a torso encircling garment with areas of adhesive material on the inner surface of the garment.

OBJECTS and ADVANTAGES

Accordingly, the objects and advantages of the breast support system presented in this invention are:

to keep the garment and breasts in place by employing areas on the inner surface of the garment of a thin layer of frictionally adhesive materials such as 100 percent silicon rubber or latex rubber, with a thickness between 0.001 to 0.5 millimeter, (b) to avoid discomfort by positioning the areas of silicone or latex rubber so that the areas do not tightly encircle the torso, and such that these areas do not employ protuberances from the surface of the garment or methods to create suction, eliminating the problem of loss of adhesiveness when air pressure is equalized through normal movement of the wearer and its resultant loss of suction, (c) to create stability in the positioning of the garment by having the areas of adhesive material in contact with the skin, that is, the material is on the inner surface of the fabric of the garment, (d) to provide for a variety of adaptations of the present iventivegarment to any garment that functions to control the movement and position of breasts, such as sports, nursing, general purpose, strapless and padded brassieres, and sleep wear support, or garments that have this invention built into them, such as sports wear, leotards, swim suits, evening gowns, pajamas and night gowns, (e) to provide garments that are easy to take care of, (f) to provide garments that will fit into many price ranges, and (g) to provide the wearer with a secure feeling of knowing that her garment will stay in place and that she looks her best.

DRAWING FIGURES

In the drawings, parts that are closely related have the same number.

REFERENCE NUMERALS IN DRAWINGS

10 sports brassiere

11 front portion, outside view

12 back portion, inside view

13 outer shell of brassiere

14 lining of brassiere

Figure 1:
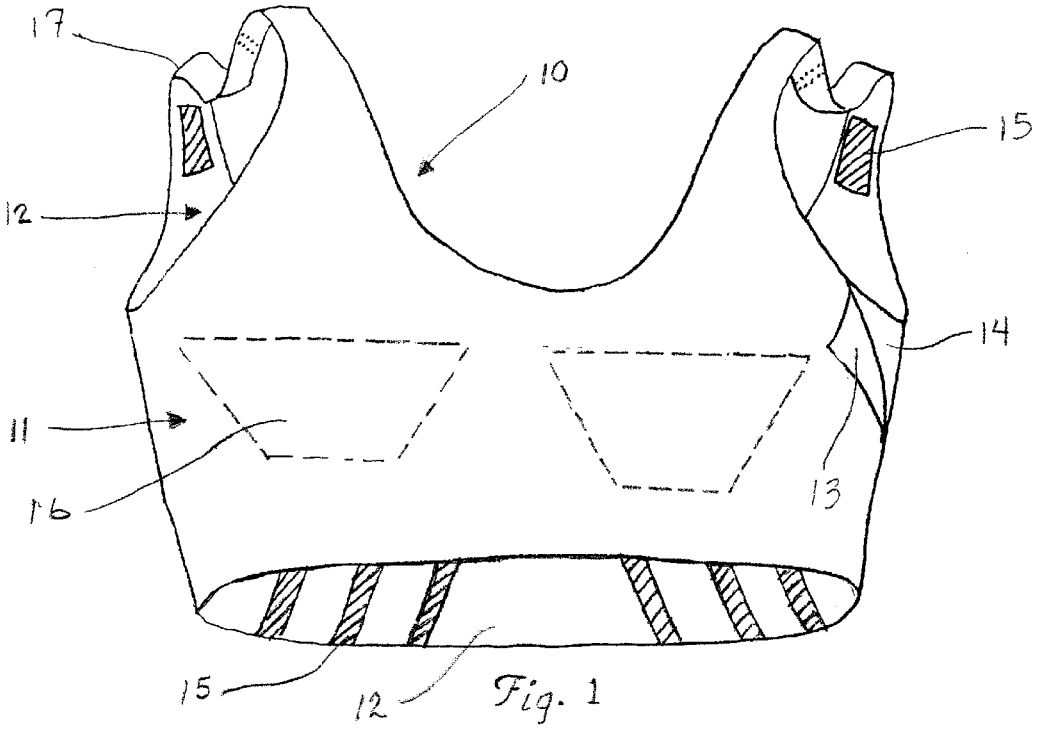
FIG. 1 shows the outside of a sports brassiere and FIG. 2 shows the inside of the same garment.

15 silicone or rubber material that is on the fabric surface

16 breast supporting area

17 straps continuous with the front and back portions

18 front portion, inside view

19 back portion, outside view

20 general purpose brassiere

21 conventional straps

22 breast supporting area or general purpose brassiere

23 knitted of woven fabric from yarn containing elastic yarn as a component

24 back hook and eye closure

25 under wire

30 strapless brassiere

31 molded cups

32 stays

33 front hook and eye closure

Figure 2:
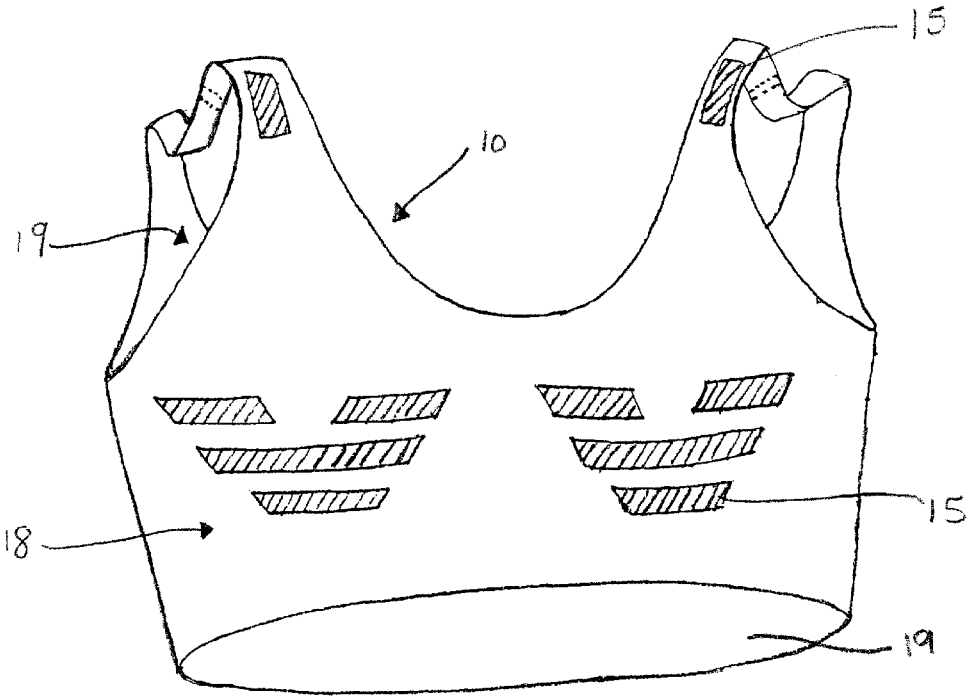

Description—FIGS. 1 and 2—Sports Brassiere Embodiment

The sports brassiere embodiment 10 viewed right side out of this invention is illustrated in FIG. 1 and in FIG. 2, the garment is viewed inside out. This brassiere 10 has a front portion 11 attached to a back portion 12. This garment is comprised of two layers of fabric, the outer layer 13 and the inner layer 14, and this double layer gives extra support to the breasts. The preferred materials for these layers of fabric are knitted fabrics comprised of absorbing or wicking yarns with an elastic yarn as part. The areas comprised of a thin layer of silicone rubber or latex rubber on the surface of the fabric 15 and are placed on the inner surface of the garment on the back 12, straps 17 and cup area 16. These areas together serve the function of keeping the garment in place, but not all of them are necessary to perform the function and one can be omitted. This garment has no front or back opening and can be put on by pulling on over the head or stepping into it.

Figure 3:
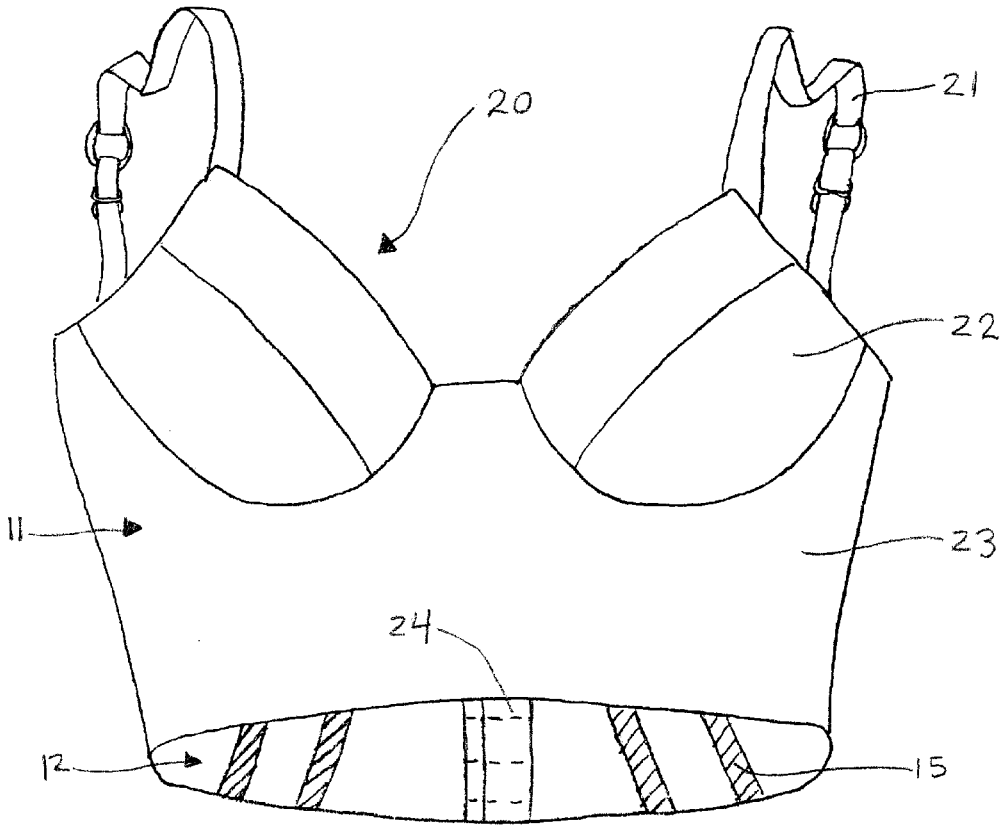
FIG. 3 shows the outside of a general purpose brassiere and FIG. 4 shows the inside of the same garment.
Figure 4:
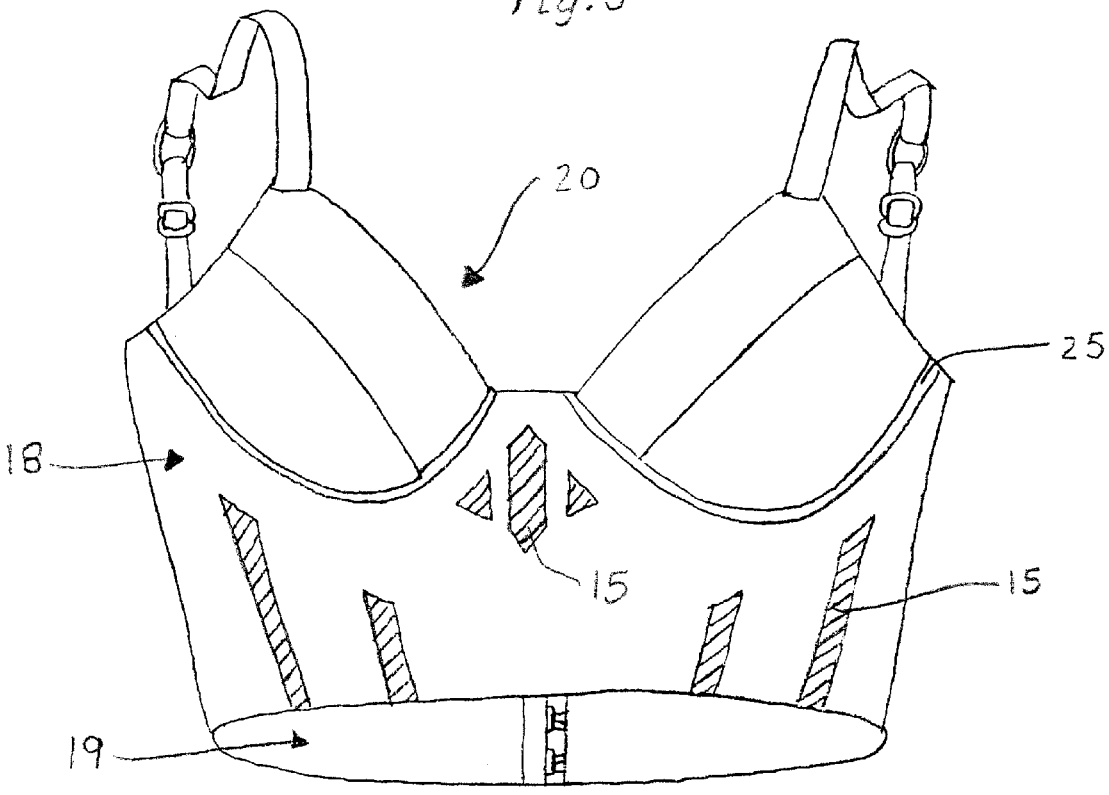

FIGS. 3 and 4 Additional Embodiment

The general purpose brassiere embodiment 20 of this invention is illustrated in FIG. 3, right side out, and FIG. 4 inside out. This brassiere 20 has a front portion 11 attached to a back portion 12 and conventional brassiere straps 21. The cup area 22 is a single or multiple thickness of woven or knitted fabric, with or without elastic yarn as part of the knitted or woven yarn, with the type of fabric chosen for the desired amount of support. The fabric encircling the torso is a single or multiple layer of knitted or woven fabric with elastic yarn as part of the of the yarn, allowing for freedom and comfort in breathing. The hatched areas 15 are the areas comprised of a thin layer of silicone rubber or latex rubber on the surface of the fabric, here to hold the brassiere in place, while the under wire 25 serves the function of keeping the breasts from sliding down to a position below the cup area 22. This brassiere has a back hook and eye closure 24. This embodiment of the invention is useful for the creation of a shapely appearance.

Figure 5:
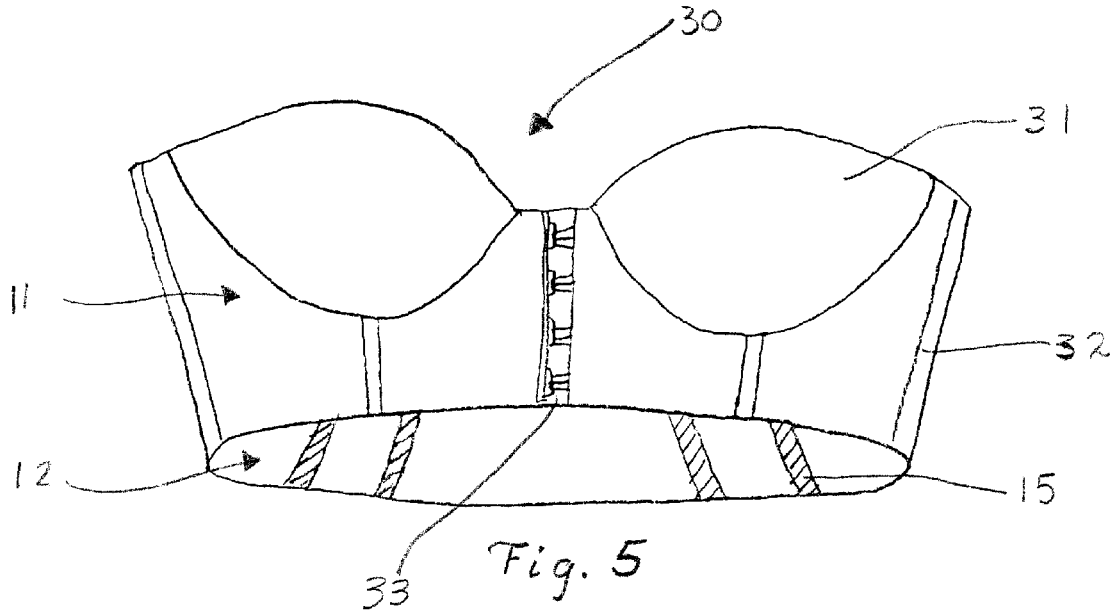
FIG. 5 shows the outside of a strapless brassiere and FIG. 6 shows the inside of the same garment.

FIGS. 4 and 5 Additional Embodiment

Figure 6:
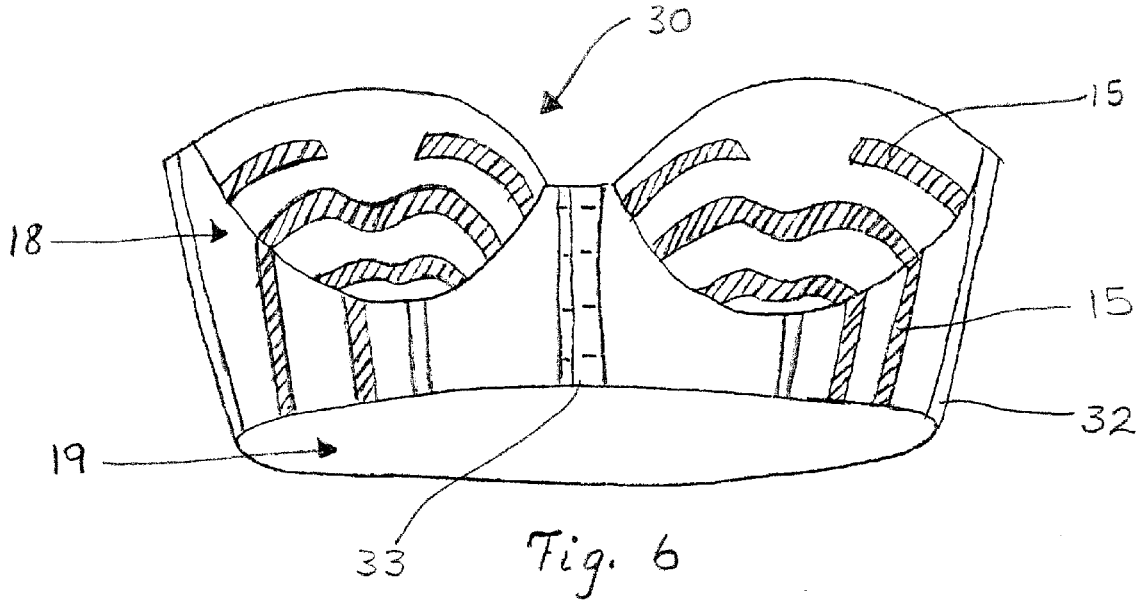

The strapless brassiere embodiment 30 is illustrated in FIG. 5 and FIG. 6 and has a front portion 11 attached to a back portion 12. The cups 31 are of the molded type and also have thin layers of silicone rubber or latex rubber on the surface of the fabric 15 to help to position the breasts. The The areas of silicone rubber or latex rubber 15 around the torso 12 and 18 serves the function of keeping the brassiere from sliding down. This brassiere can be, as with other embodiments, constructed of single or multiple layers of a variety of fabrics, and again the preferred fabric for the portion encircling the torso will contain elastic yarn as part of the yarn to provide for comfort in breathing and movement of the wearer. This embodiment of the invention has a front hook and eye closure 33.

This illustrations are not intended to exclude other placement of adherent material, other combinations of fabrics, other constructions or other types of garments, but is intended to illustrate that there is a range of possible features and garments.

Advantages, Conclusions and Scope

The my garment is a method to provide comfort and control in a breast supporting garment that encircles the torso and has areas of a thin layer of silicone rubber or latex on the inner surface of the garment, that is, the surface of fabric that touches the wearer's skin. This system performs its control function while permitting freedom for breathing and movement. By eliminating the need for a tight band encircling the torso, this invention departs from the conventional conception and previous art of garments that encircle the torso and support breasts with the use of the tight encircling band. Because of the increased comfort, wearers will find that my invention System can be worn in any circumstance, including, but not exclusive to sports, dancing and sleeping.

I claim:

1. A breast supporting garment including a torso portion, a breast supporting front portion and a back portion;

said garment being comprised of elastic fabric and having areas of non-slipping material on a surface of said fabric; said areas being of sufficient size and location to counter the tendency of said garment to slide out of place on the wearer's body;

(a) said areas of non-slipping material being comprised of silicon or latex rubber;

(b) said areas of non-slipping material having a thikness in the range of 0.001–0.5 mm in order to maintain the integrity o said non-slipping material;

(c) said areas of non-slipping material being permanently affixed to said garment;

(d) said garment being of construction including elastic materials so as to be under sufficient tension on said wearer's body to maintain contact between said areas of non-slipping material with said wearer's skin;

(e) said areas of non-slipping material being on an inner surface of said garment and being the surfaace of said garment in contact with said wearer's skin;

(f) said areas of non-slipping material being located on said garment inner surface in at least any one of the following garment locations or any combination thereof including on straps, cup areas or the torso encircling portion.

* * * * *

UNITED STATES PATENT AND TRADEMARK OFFICE

CERTIFICATE OF CORRECTION

PATENT NO. : 6,332,825 B1
DATED : December 25, 2001
INVENTOR(S) : Victoria Elizabeth Henricksen It is certified that error appears in the above-identified patent and that said Letters Patent is hereby corrected as shown below:

Column 2,
Line 14, change "silicon" to -- silicone --.
Line 62, replace all of "silicone or rubber material that is on the fabric surface" with -- adhesive material such as 100 percent silicone rubber or latex rubber with a thickness of .001 mm to .5 mm, --.

Column 4,
Line 38, change "silicon" to -- silicone --.

Signed and Sealed this

Twenty-second Day of July, 2003

JAMES E. ROGAN
*Director of the United States Patent and Trademark Office*